US008167452B2

(12) United States Patent
Chou

(10) Patent No.: US 8,167,452 B2
(45) Date of Patent: May 1, 2012

(54) LIGHTING APPARATUS

(75) Inventor: Shih-Chin Chou, Hsinchu (TW)

(73) Assignee: Lextar Electronics Corporation, Hsinchu (TW)

( * ) Notice: Subject to any disclaimer, the term of this patent is extended or adjusted under 35 U.S.C. 154(b) by 95 days.

(21) Appl. No.: 12/875,497

(22) Filed: Sep. 3, 2010

(65) Prior Publication Data

US 2011/0194296 A1 Aug. 11, 2011

Related U.S. Application Data

(63) Continuation-in-part of application No. 12/703,284, filed on Feb. 10, 2010.

(51) Int. Cl.
*F21V 21/00* (2006.01)

(52) U.S. Cl. ..... 362/217.13; 362/217.12; 362/659

(58) Field of Classification Search ..... 362/217.01, 362/221, 222, 217.1, 217.12, 217.13, 659, 362/249.02

See application file for complete search history.

(56) References Cited

U.S. PATENT DOCUMENTS

| | | | | |
|---|---|---|---|---|
| 7,052,171 | B1 * | 5/2006 | Lefebvre et al. | 362/217.12 |
| 7,270,443 | B2 | 9/2007 | Kurtz et al. | |
| 7,594,738 | B1 * | 9/2009 | Lin et al. | 362/249.02 |
| 2009/0091929 | A1 | 4/2009 | Faubion | |
| 2009/0159919 | A1 | 6/2009 | Simon et al. | |

* cited by examiner

*Primary Examiner* — David V Bruce
(74) *Attorney, Agent, or Firm* — WPAT, P.C.; Anthony King

(57) ABSTRACT

A lighting apparatus includes a housing, a light source disposed in the housing and at least one adjustable assembly disposed at an end of the housing. The adjustable assembly includes a connection element fixed to the end of the housing, a cap capping the connection element, at least one electrical terminal and an adjusting mechanism. A part of the connection element is located in the cap. The electrical terminal is disposed at the cap and electrically connected to the light source. The adjusting mechanism includes a gear, a positioning element, a clasp and a track. The gear and the positioning element are respectively disposed at the connection element and the cap. Positions of the gear and the positioning element can be exchanged. The clasp and the track are respectively disposed at the connection element and the cap. Positions of the clasp and the track can be exchanged.

5 Claims, 10 Drawing Sheets

LIGHTING APPARATUS

CROSS-REFERENCE TO RELATED APPLICATIONS

This application is based upon and claims the benefit of priority from the prior U.S. Patent Application No. 12/703,284, filed Feb. 10, 2010, the entire contents of which are incorporated herein by reference.

BACKGROUND

1. Field of the Invention

The present invention relates generally to an electrical apparatus. More particularly, the present invention relates to a lighting apparatus.

2. Detailed Description of the Related Art

Commercial light fixtures commonly use fluorescent lamps or incandescent lamps to radiate light for illumination. These lighting fixtures have the common drawbacks of high power consumption, quick light attenuation, short service life, fragility, and the inability to be reclaimed. Light emitting diode elements (hereinafter LED elements) may be used to replace fluorescent or incandescent bulbs to obtain the environmental and economic benefits of LED technology. However, LED elements are directional and when used with exiting light fixtures, they do not necessarily provide the illumination where it is needed.

Standard light tubes are mounted in a light fixture by means of sliding connector pins into end sockets and then turning the tube 90 degrees so that the pins engage electrical contacts in the sockets. The lamp tube emits light omni-directionally and its orientation in the sockets is of no consequence, making orientation of pin connectors on different models of fixtures inconsequential. However, LED elements emit light generally at a narrowly-angled conical path. An LED lighting tube retrofitted into the exiting light fixture may not be oriented to emit light in the desired direction as the angular presentation of the light to the surface to be illuminated can be offset by the variation of the pin connectors.

BRIEF SUMMARY

The present invention is directed to provide a lighting apparatus with an adjustable assembly.

In one embodiment, a lighting apparatus includes a housing, a light source and at least one adjustable assembly. The light source is disposed in the housing, and the adjustable assembly is disposed at an end of the housing and includes a connection element, a cap, at least one electrical terminal and an adjusting mechanism. The connection element is fixed to the end of the housing. The cap caps the connection element, wherein the cap includes a side wall, an end wall and an opening, the side wall is disposed at the end wall, the opening is disposed at the side wall and opposite to the end wall, the side wall and the end wall together form an accommodating space, the connection element passes through the opening, and a part of the connection element is located in the accommodating space. The electrical terminal is disposed at the end wall and extends outside the cap. The electrical terminal is electrically connected to the light source. The adjusting mechanism includes a gear, a positioning element, a clasp and a track. One of the gear and the positioning element is disposed at the connection element, the other of the gear and the positioning element is disposed at the cap and located in the accommodating space, one of the clasp and the track is disposed at the connection element, and the other of the clasp and the track is disposed at the cap and located in the accommodating space. When the cap is at a first position, the positioning element is engaged with the gear to be restricted by the gear such that the cap is not rotated relative to the connection element. When the cap is at a second position, the positioning element is not restricted by the gear and the clasp is disposed at the track such that the cap is adapted to be rotated relative to the connection element and the clasp is adapted to slide along the track.

In one embodiment of the present invention, the track has a first trench and a second trench, wherein the clasp clasps the first trench when the cap is at the first position, and the clasp is disposed at the second trench when the cap is at the second position.

In one embodiment of the present invention, the positioning element is a protrusion.

In one embodiment of the present invention, the adjusting assembly further includes a medium element disposed in the cap, the positioning element includes a ring-shaped body encircling the medium element and a rod disposed at the ring-shaped body. The rod is engaged with the gear when the cap is at the first position.

In one embodiment of the present invention, the clasp is a protrusion.

Because the housing and the connection element of the lighting apparatus of each of the embodiments can be rotated relative to the cap, the lighting apparatus of each of the embodiments is applicable to the present exiting light fixture and the light from the lighting source can be directed to illuminate the desired surface or area.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DETAILED DESCRIPTION

Reference will now be made to the drawings to describe exemplary embodiments of the present sensing system, in detail. The following description is given by way of example, and not limitation.

Figure 1A:
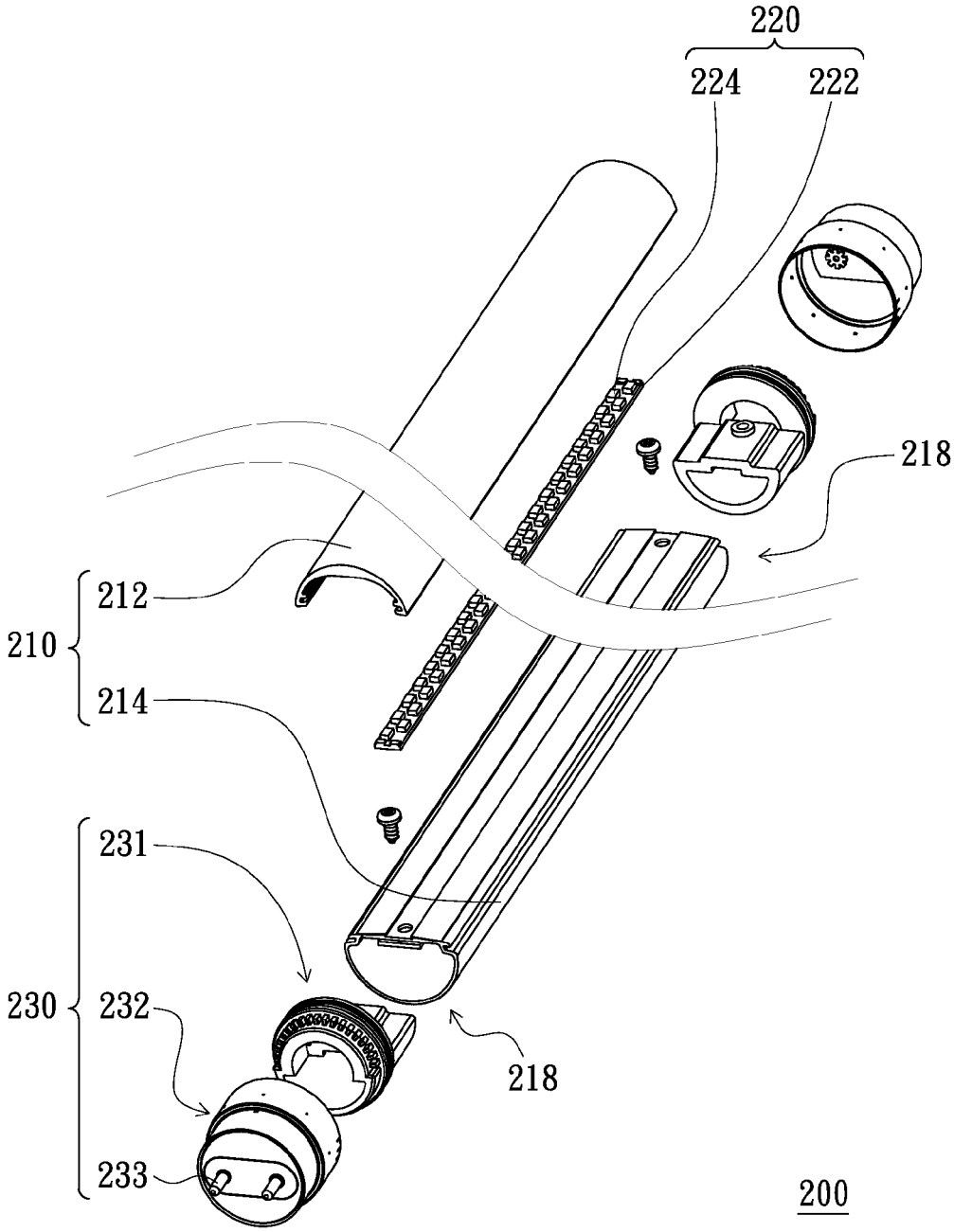
FIG. 1A is a partially-exploded schematic view of a lighting apparatus of a first embodiment of the present invention.
Figure 1B:
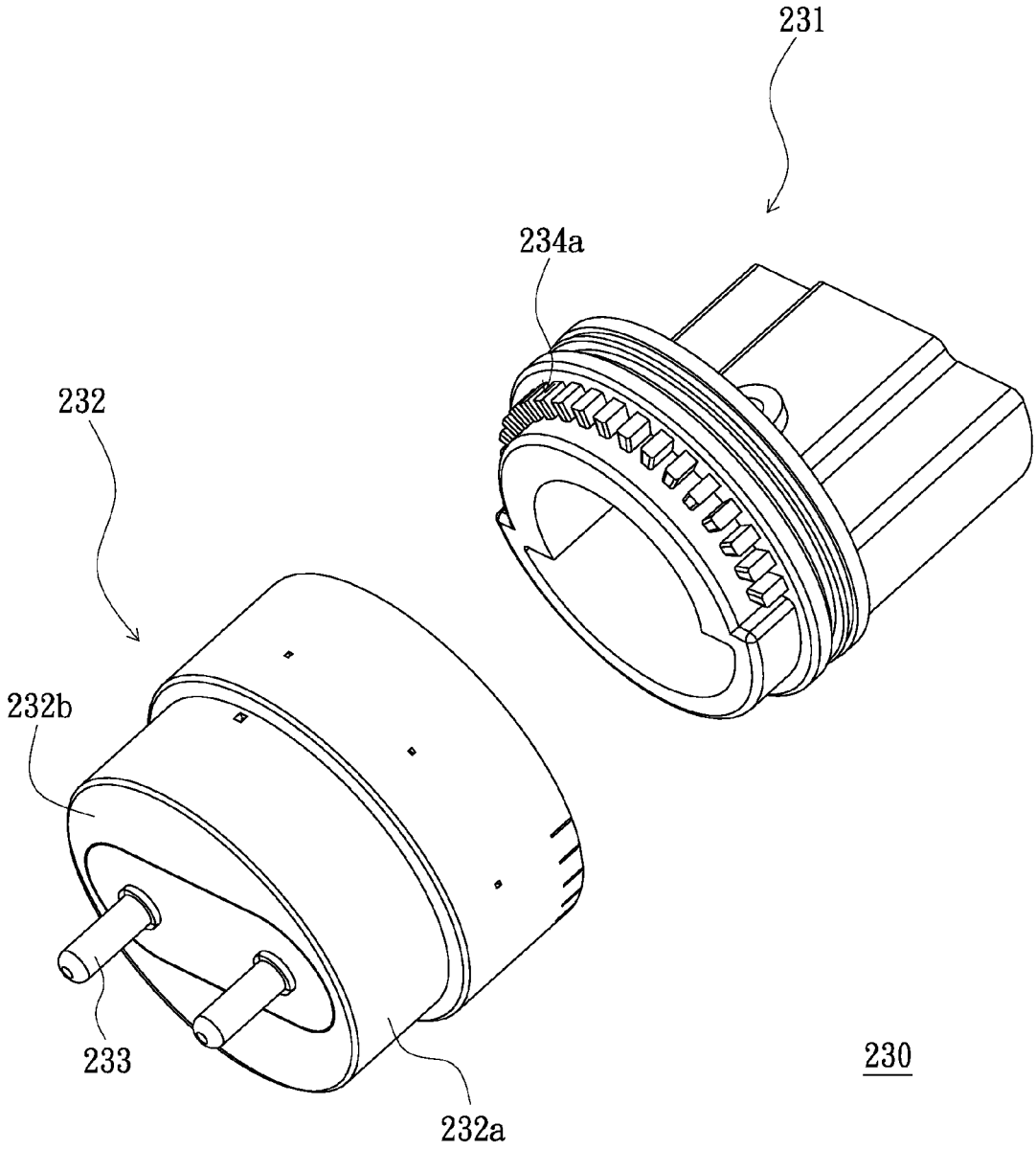
FIG. 1B is a partially-exploded schematic view of an adjustable assembly of FIG. 1A.
Figure 1C:
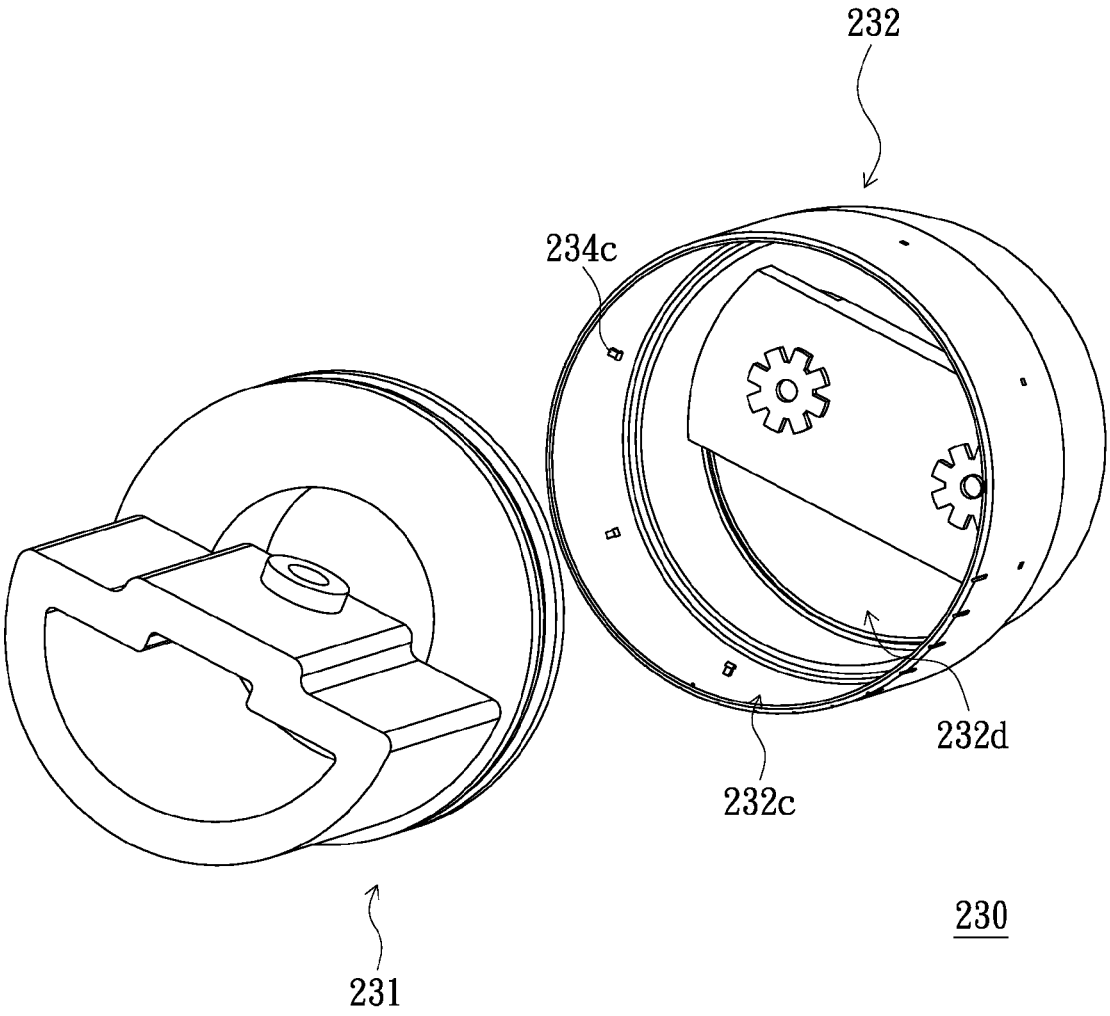
FIG. 1C is another partially-exploded schematic view of the adjustable assembly of FIG. 1B.
Figure 1D:
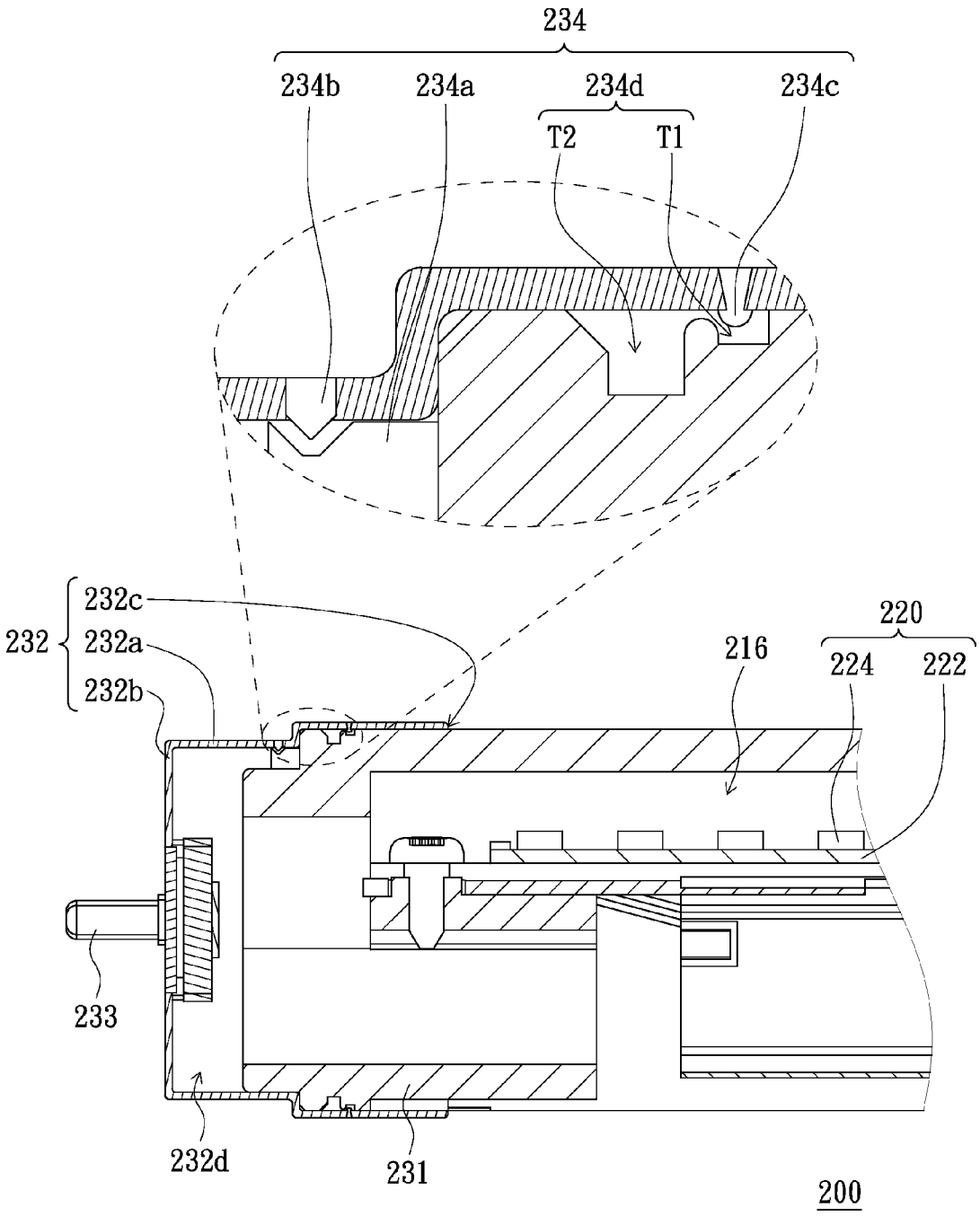
FIG. 1D is a cross-sectional schematic view of the lighting apparatus of the first embodiment as the cap is at a first position.
Figure 1E:
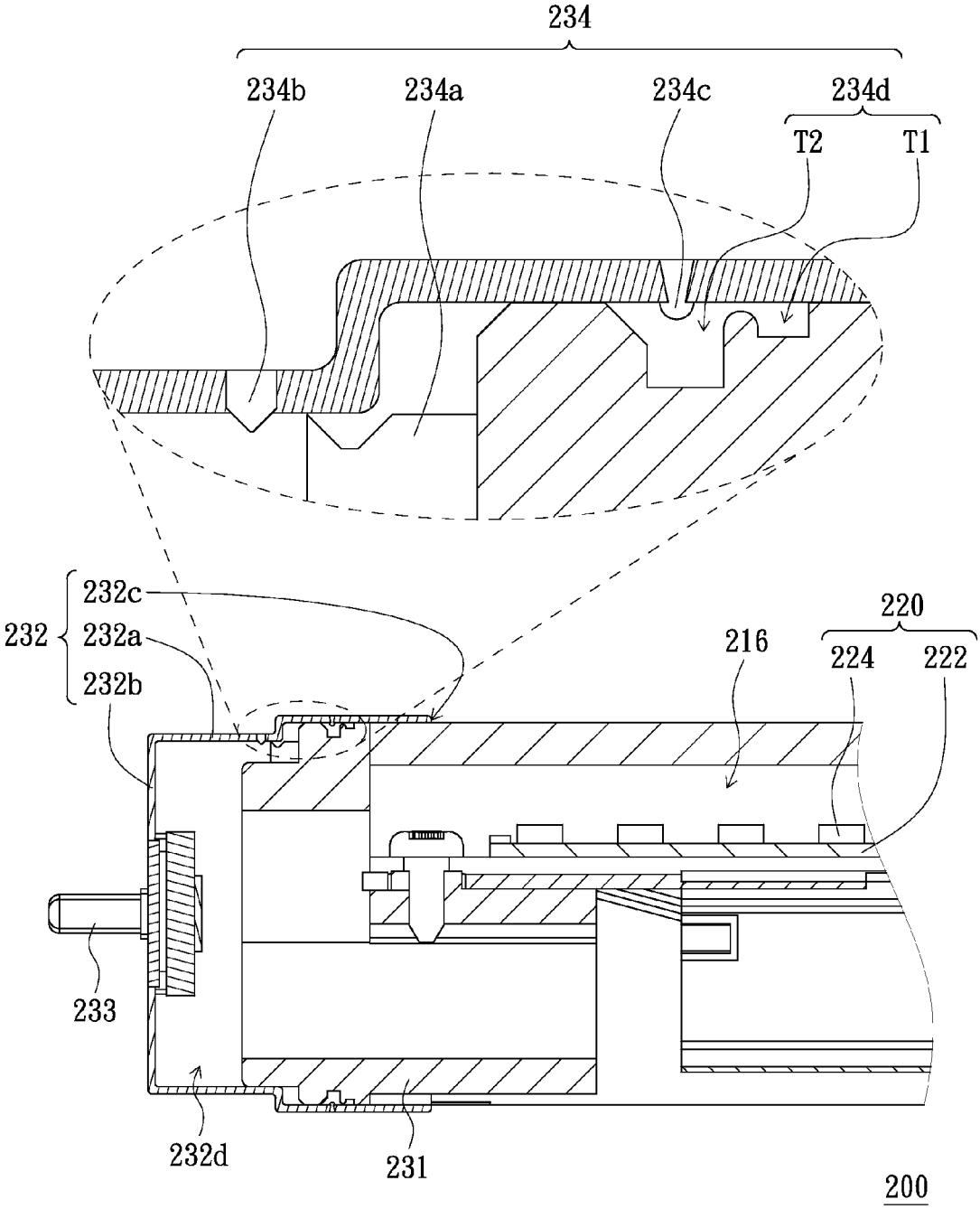
FIG. 1E is a cross-sectional schematic view of the lighting apparatus of the first embodiment as the cap is at a second position.

FIG. 1A is a partially-exploded schematic view of a lighting apparatus of a first embodiment of the present invention, FIG. 1B is a partially-exploded schematic view of an adjustable assembly of FIG. 1A, FIG. 1C is another partially-exploded schematic view of the adjustable assembly of FIG. 1B, FIG. 1D is a cross-sectional schematic view of the lighting apparatus of the first embodiment as the cap is at a first position, and FIG. 1E is a cross-sectional schematic view of the lighting apparatus of the first embodiment as the cap is at a second position. Referring to FIGS. 1A to 1E, a lighting apparatus 200 includes a housing 210, a light source 220 and at least one adjustable assembly 230 (two adjustable assemblies 230 are schematically shown in FIG. 1A). The housing 210 may include a transparent front portion 212 and a rigid back portion 214. The rigid back portion 214 may be a heat sink. The transparent front portion 212 may be sliding disposed at the rigid back portion 214 such that the transparent front portion 212 and the rigid back portion 214 together form an accommodating space 216.

The light source 220 is disposed in the housing 210. Particularly, the light source 220 may include a circuit board 222 and a plurality of LED elements 224. The LED elements 224 are electrically disposed on the circuit board 222. The circuit board 222 is disposed on the rigid back portion 214 such that the light source 220 is located in the accommodating space 216. When the LED elements 224 operate to illuminate light, the heat generated by the LED elements 224 can be transferred to the outside environment through a plurality of heat conductive channels (not shown) of the circuit board 222 and the rigid back portion 214 such as the heat sink.

The adjustable assemblies 230 are disposed at two opposite ends 218 of the housing 210. Each of the adjustable assemblies 230 includes a connection element 231, a cap 232, at least one electrical terminal 233 (two electrical terminals 233 are schematically illustrated in FIG. 1B) and an adjusting mechanism 234. The connection elements 231 of the adjustable assemblies 230 may be inserted into the rigid back portion 214 to be fixed to the ends 218 of the housing 210, respectively. The cap 232 of each adjustable assembly 230 caps the connection element 231, wherein the cap 231 includes a side wall 232*a*, an end wall 232*b* and an opening 232*c*. The side wall 232*a* is disposed at the end wall 232*b*, the opening 232*c* is disposed at the side wall 232*a* and opposite to the end wall 232*b*, the side wall 232*a* and the end wall 232*b* together form an accommodating space 232*d*, the connection element 231 passes through the opening 232*c*, and a part of the connection element 231 is located in the accommodating space 232*d*. The electrical terminals 233, such as pins, are disposed at the end wall 232*b* and extend outside the cap 232. The electrical terminals 233 are electrically connected to the circuit board 222 of the light source 220. In one embodiment, the electrical terminals 233 can be electrically connected to the circuit board 222 of the light source 220 through wires (not shown). The electrical terminals 233 of each of the adjustable assemblies 230 can be inserted into one of two sockets of a standard fluorescent or incandescent light fixture (not shown).

In each of the adjustable assemblies 230, the adjusting mechanism 234 includes a gear 234*a*, a positioning element 234*b*, a clasp 234*c* and a track 234*d*. The positioning element 234*b* is, for example, a protrusion, and the clasp 234*c* is, for example, a protrusion. One of the gear 234*a* and the positioning element 234*b* (e.g. the gear 234*a*) is disposed at the connection element 231, the other of the gear 234*a* and the positioning element 234*b* (e.g. the positioning element 234*b*) is disposed at the cap 232 and located in the accommodating space 232*d*. One of the clasp 234*c* and the track 234*d* (e.g. the track 234*d*) is disposed at the connection element 231, and the other of the clasp 234*c* and the track 234*d* (e.g. the clasp 234*c*) is disposed at the cap 232 and located in the accommodating space 232*d*. In another embodiment, the positioning element 234*b* is disposed at the connection element 231, the gear 234*a* is disposed at the cap 232 and located in the accommodating space 232*d*, the clasp 234*c* is disposed at the connection element 231, and the track 234*d* is disposed at the cap 232 and located in the accommodating space 232*d*.

Referring to FIG. 1D, when the cap 232 of each adjustable assembly 230 is at a first position, the positioning element 234*b* is engaged with the gear 234*a* to be restricted by the gear 234*a* such that the cap 232 is not rotated relative to the connection element 231. Referring to FIG. 1E, when the cap 232 of each adjustable assembly 230 is at a second position, the positioning element 234*b* is not restricted by the gear 234*a* and the clasp 234*c* is disposed at the track 234*d* such that the cap 232 is adapted to be rotated relative to the connection element 231 and the clasp 234*c* is adapted to slide along the track 234*d* to direct the light from the LED elements 224 to illuminate the desired surface or area. In one embodiment, the track 234*d* has a first trench T1 and a second trench T2, wherein the clasp 234*c* clasps the first trench T1 when the cap 232 is at the first position, and the clasp 234*c* is disposed at the second trench T2 when the cap 232 is at the second position.

When the housing 210 and the connection elements 231 are adjusted to an adequate position, the user can shift the caps 232 to the first position such that the final position of the housing 210 and the connection elements 231 is maintained. Because the caps 232 can be shifted to the second position to disengage the positioning element 234*b* and the gear 234*a* such that the housing 210 and the connection elements 231 can be rotated relative to the caps 232. The lighting apparatus 200 of the first embodiment is applicable to the present exiting light fixture and the light from the lighting source 220 can be directed to illuminate the desired surface or area.

Figure 2A:
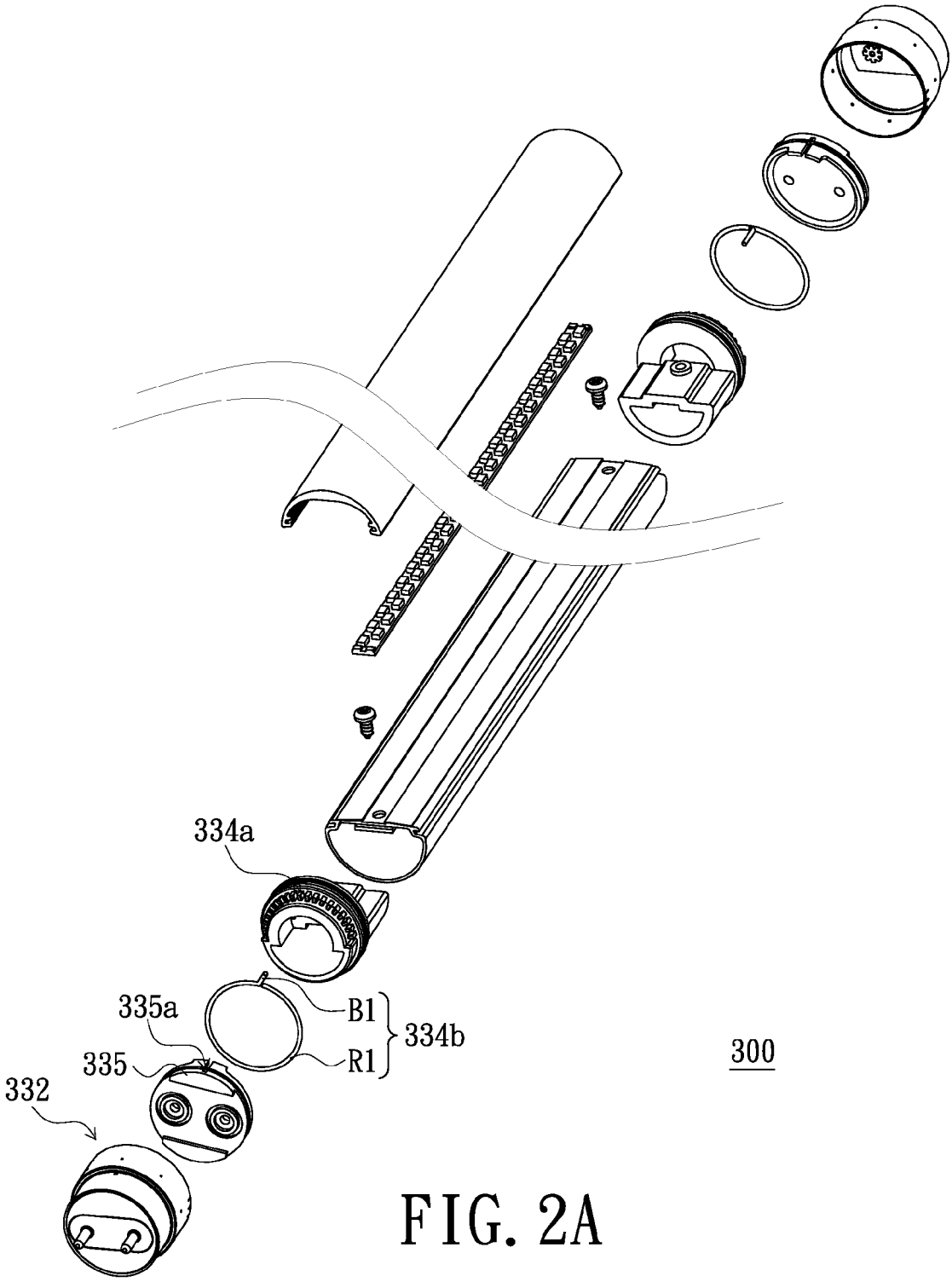
FIG. 2A is a partially-exploded schematic view of a lighting apparatus of a second embodiment of the present invention.
Figure 2B:
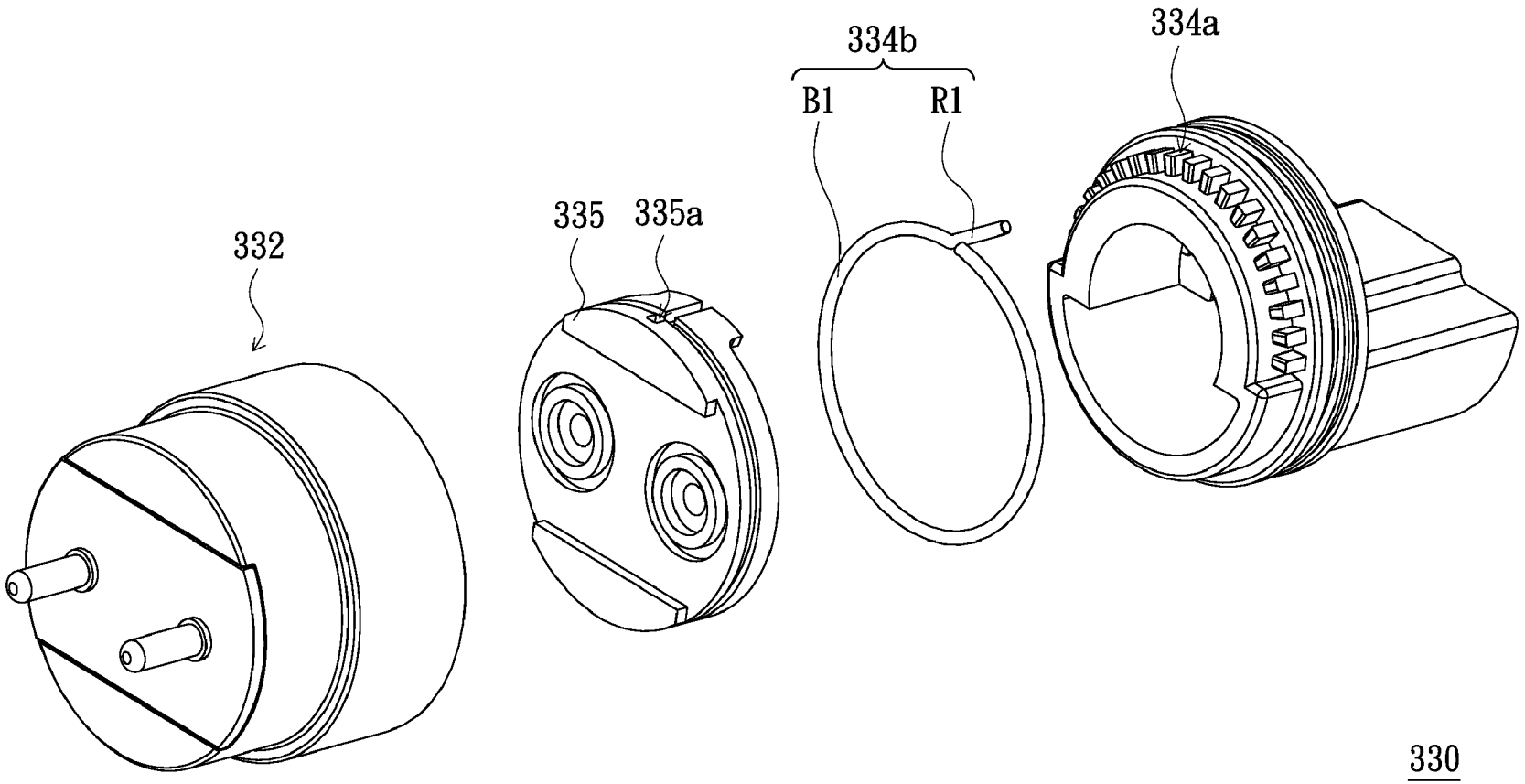
FIG. 2B is a partially-exploded schematic view of an adjustable assembly of a second embodiment of the present invention.
Figure 2C:
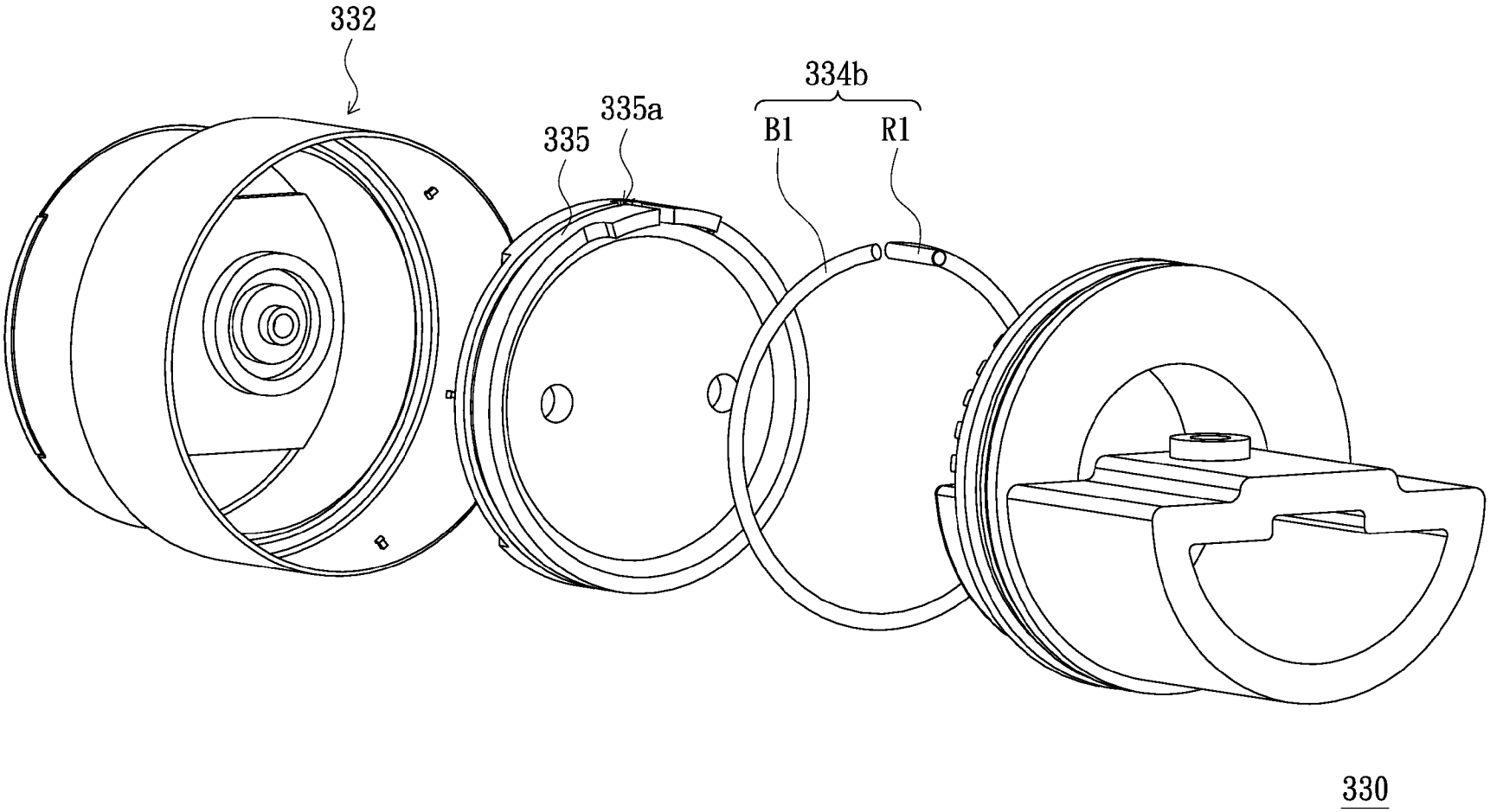
FIG. 2C is another partially-exploded schematic view of the adjustable assembly of FIG. 2A.
Figure 2D:
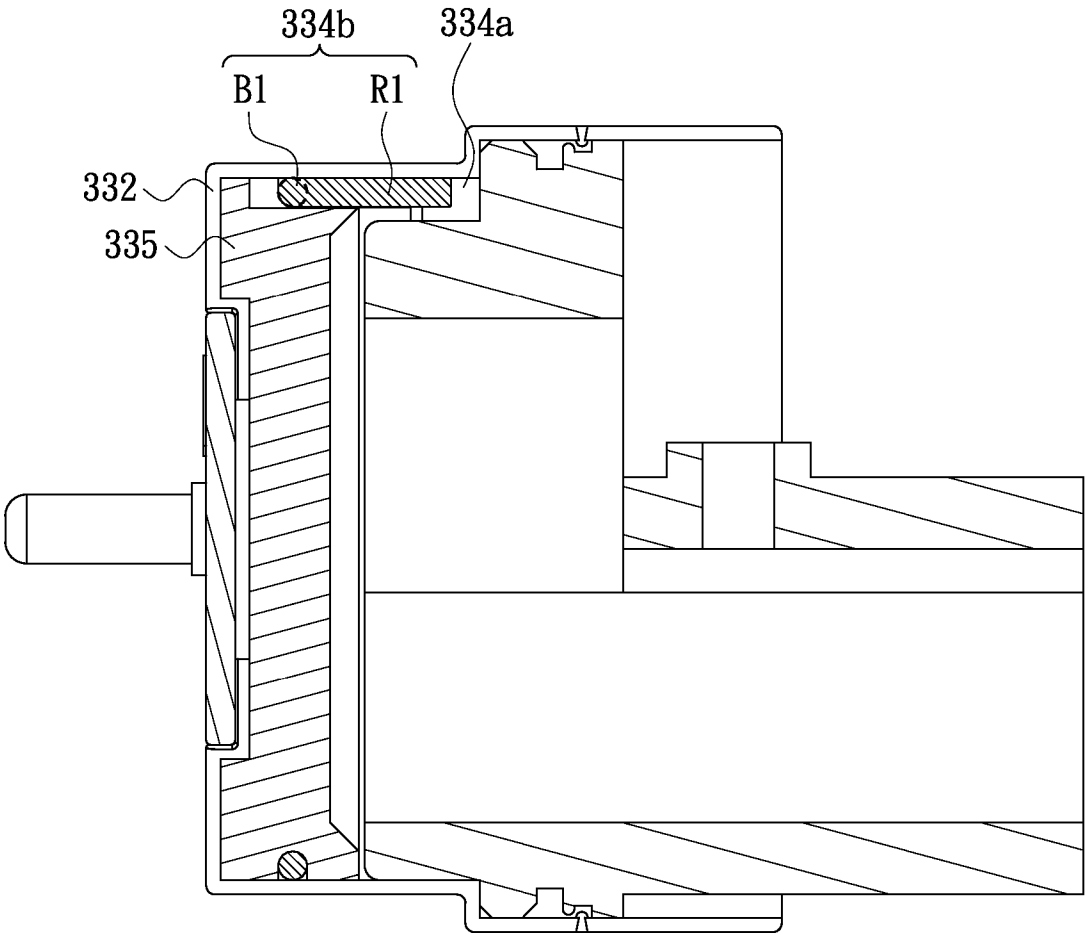
FIG. 2D is a cross-sectional schematic view of the adjustable assembly of the second embodiment as the cap is at a first position.
Figure 2E:
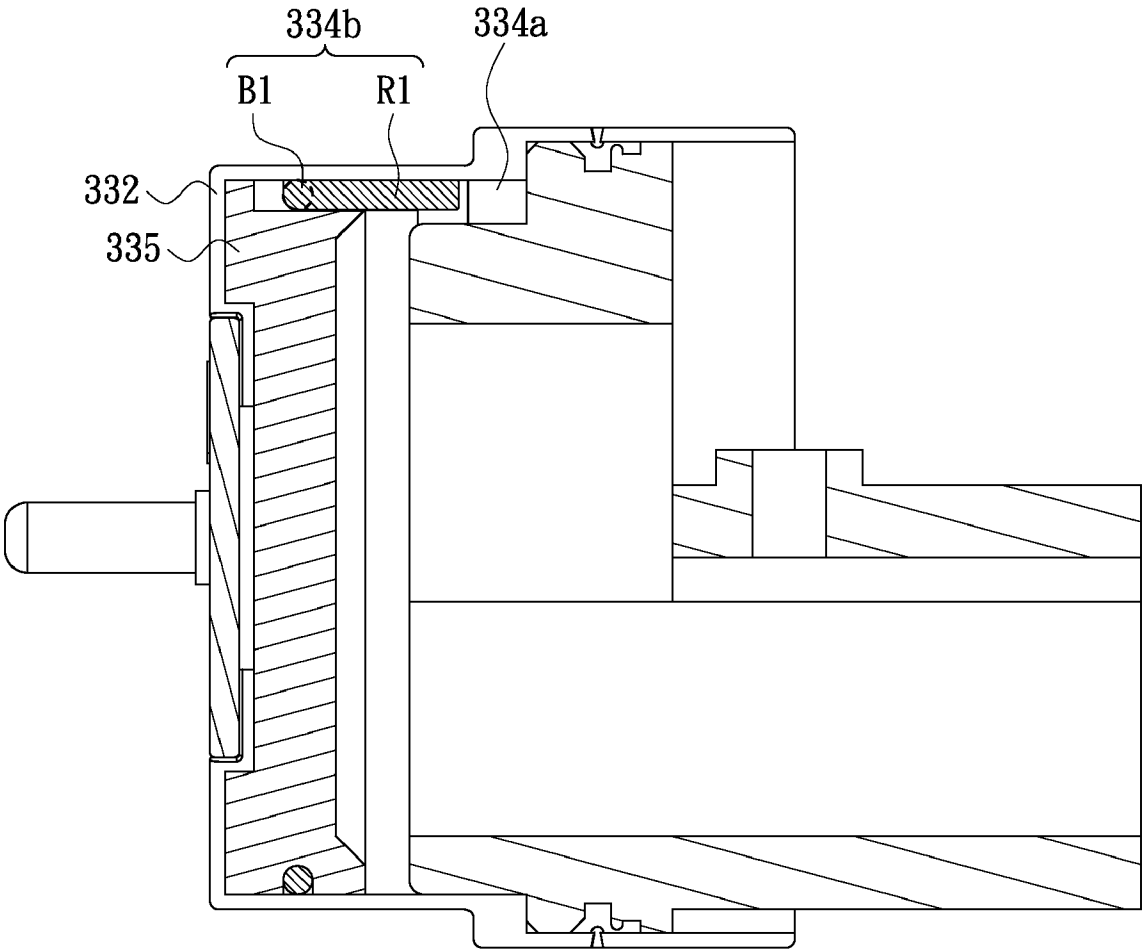
FIG. 2E is a cross-sectional schematic view of the adjustable assembly of the second embodiment as the cap is at a second position.

FIG. 2A is a partially-exploded schematic view of a lighting apparatus of a second embodiment of the present invention. FIG. 2B is a partially-exploded schematic view of an adjustable assembly of a second embodiment of the present invention, FIG. 2C is another partially-exploded schematic view of the adjustable assembly of FIG. 2A, FIG. 2D is a cross-sectional schematic view of the adjustable assembly of the second embodiment as the cap is at a first position, and FIG. 2E is a cross-sectional schematic view of the adjustable assembly of the second embodiment as the cap is at a second position. Referring to FIGS. 2A to 2E, the main difference between the lighting apparatus 300 of the second embodiment and the lighting apparatus 200 of the first embodiment lies in that each of the adjustable assemblies 330 of the lighting apparatus further includes a medium element 335 disposed in the cap 332, the positioning element 334*b* includes a ring-shaped body B1 encircling the medium element 335 and a rod R1 disposed at the ring-shaped body B1. More specifically, the medium element 335 has a trench 335*a* and the ring-shaped body B1 is disposed in the trench 335*a* to encircling the medium element 335. The rod R1 is engaged with the gear 334*a* when the cap 332 is at the first position (shown in FIG. 2D).

Because the caps 332 can be shifted to the second position to disengage the rod R1 of the positioning element 334*b* and the gear 334*a* such that the housing 310 and the connection elements 331 can be rotated relative to the caps 332. The lighting apparatus of the second embodiment is applicable to the present exiting light fixture and the light from the lighting source 320 can be directed to illuminate the desired surface or area.

According to the above description, because the housing and the connection element of the lighting apparatus of each of the embodiments can be rotated relative to the cap, the lighting apparatus of each of the embodiments is applicable to the present exiting light fixture and the light from the lighting source can be directed to illuminate the desired surface or area.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A lighting apparatus comprising:

a housing;

a light source disposed in the housing; and at least one adjustable assembly disposed at an end of the housing and comprising:

a connection element fixed to the end of the housing;

a cap capping the connection element, wherein the cap comprises a side wall, an end wall and an opening, the side wall is disposed at the end wall, the opening is disposed at the side wall and opposite to the end wall, the side wall and the end wall together form an accommodating space, the connection element passes through the opening, and a part of the connection element is located in the accommodating space;

at least one electrical terminal disposed at the end wall and extending outside the cap, wherein the electrical terminal is electrically connected to the light source; and an adjusting mechanism comprising a gear, a positioning element, a clasp and a track, wherein one of the gear and the positioning element is disposed at the connection element, the other of the gear and the positioning element is disposed at the cap and located in the accommodating space, one of the clasp and the track is disposed at the connection element, and the other of the clasp and the track is disposed at the cap and located in the accommodating space;

when the cap is at a first position, the positioning element is engaged with the gear to be restricted by the gear such that the cap is not rotated relative to the connection element;

when the cap is at a second position, the positioning element is not restricted by the gear and the clasp is disposed at the track such that the cap is adapted to be rotated relative to the connection element and the clasp is adapted to slide along the track.

2. The lighting apparatus as claimed in claim 1, wherein the track has a first trench and a second trench, wherein the clasp clasps the first trench when the cap is at the first position, and the clasp is disposed at the second trench when the cap is at the second position.

3. The lighting apparatus as claimed in claim 1, wherein the positioning element is a protrusion.

4. The lighting apparatus as claimed in claim 1, wherein the adjusting assembly further comprises a medium element disposed in the cap, the positioning element comprises a ring-shaped body encircling the medium element and a rod disposed at the ring-shaped body, and the rod is engaged with the gear when the cap is at the first position.

5. The lighting apparatus as claimed in claim 1, wherein the clasp is a protrusion.

* * * * *